US007080488B2

(12) United States Patent
Höcker et al.

(10) Patent No.: US 7,080,488 B2
(45) Date of Patent: Jul. 25, 2006

(54) TRANSOM-MULLION STRUCTURE

(75) Inventors: Eitel-Friedrich Höcker, Bielefeld (DE); Mohammed Hamdine, Bielefeld (DE)

(73) Assignee: Schüco International KG, Bielefeld (DE)

( * ) Notice: Subject to any disclaimer, the term of this patent is extended or adjusted under 35 U.S.C. 154(b) by 0 days.

(21) Appl. No.: 10/433,184

(22) PCT Filed: Jan. 10, 2002

(86) PCT No.: PCT/EP02/00176

§ 371 (c)(1),
(2), (4) Date: May 29, 2003

(87) PCT Pub. No.: WO02/055803

PCT Pub. Date: Jul. 18, 2002

(65) Prior Publication Data

US 2004/0031220 A1 Feb. 19, 2004

(30) Foreign Application Priority Data

Jan. 15, 2001 (DE) ..... 101 01 720

(51) Int. Cl.
*E04J 13/03* (2006.01)

(52) U.S. Cl. ..... 52/235; 52/302.3; 52/200; 52/474; 52/204.591

(58) Field of Classification Search ..... 52/484, 52/485, 488, 653.2, 655.1, 475, 204.591, 52/204.593, 302.3, 200, 474, 235
See application file for complete search history.

(56) References Cited

U.S. PATENT DOCUMENTS 4,557,089 A * 12/1985 Breithaupt ..... 52/235
4,638,613 A * 1/1987 Tonsmann ..... 52/235
4,650,702 A * 3/1987 Whitmyer ..... 428/31
4,686,805 A * 8/1987 Forslin ..... 52/208
4,974,385 A * 12/1990 McFadden et al. ..... 52/200
4,977,716 A * 12/1990 Hawkins ..... 52/235

(Continued)

FOREIGN PATENT DOCUMENTS

DE 34 19 538 A1 11/1985

(Continued)

*Primary Examiner*—Carl D. Friedman
*Assistant Examiner*—Basil Katcheves
(74) *Attorney, Agent, or Firm*—Henry M. Feiereisen

(57) ABSTRACT

A structure with vertical members and cross members, particularly for facades or light-transparent roofs, in whose frame area glass panes (100) can be inserted, comprises several vertical members (1) between which cross members (2) are fixed. Channels (3, 4) are provided on the outer surface of the vertical members (1), specifically on the edges thereof, and serve to accommodate a seal (5, 6), whereby a drainage channel (7, 8) for diverting liquid is arranged adjacent to the channel (3, 4). In addition, channels (10, 11) are provided on the side of the cross member (2), specifically on the edges thereof, that faces the outer surface of the vertical member (1), and serve to accommodate a seal (12) and a retaining strip (13) located between the channels (10, 11). According to the invention, a connecting part (40) is attached to the cross member (2) at the face thereof and serves to lengthen the channels (10, 11) and the retaining strip (13) of the cross member (2) while at least partially overlapping the channel (3) located on the edge of the vertical member. This configuration enables the cross member to be easily attached to the vertical member, whereby, for providing an overlapping design of the cross member, a connecting part is easily mounted without requiring a complex notching of the cross member (2).

16 Claims, 6 Drawing Sheets

Figure 1:
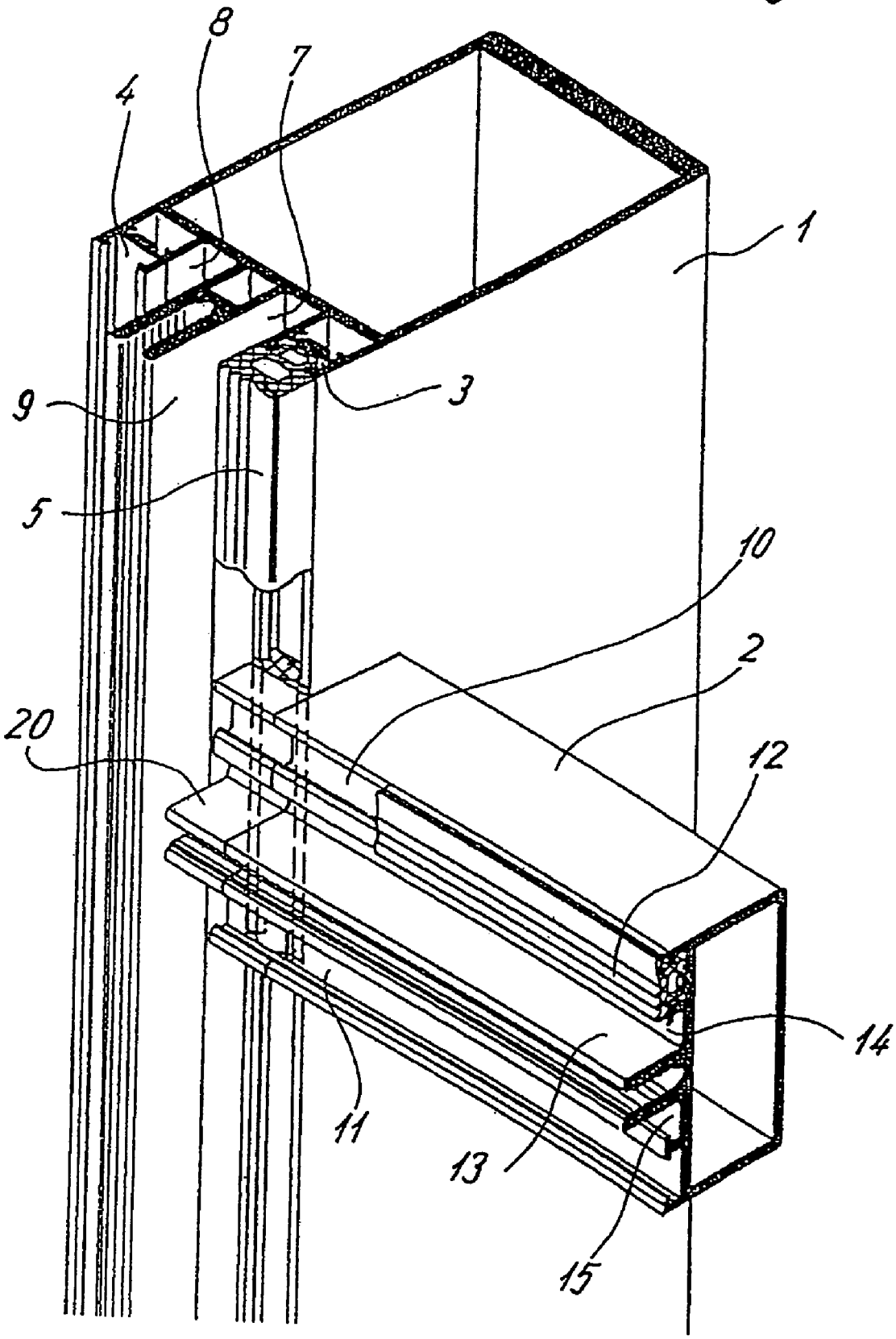

U.S. PATENT DOCUMENTS 5,067,293 A * 11/1991 Reynolds ..... 52/235
5,245,808 A * 9/1993 Grunewald et al. ..... 52/235
5,363,625 A * 11/1994 Philippi ..... 52/653.2
5,369,924 A * 12/1994 Neudorf ..... 52/235
5,603,789 A * 2/1997 Whitmyer ..... 156/108
6,032,423 A * 3/2000 Takemura et al. ..... 52/235
6,125,606 A * 10/2000 Larsson ..... 52/726.2
6,141,923 A * 11/2000 Habicht et al. ..... 52/235
6,390,718 B1 * 5/2002 Steege ..... 403/187

FOREIGN PATENT DOCUMENTS

EP 0 884 426 A 12/1998
GB 2 170 238 A 7/1986

* cited by examiner 2
14
13
10
15
71
11
81
80
40'
50'
55
3
7
8
4
70
9
1
16
61
90
43
44

TRANSOM-MULLION STRUCTURE

The present invention relates to a structure with vertical members and cross members, in particular for facades or roof windows with frame areas in which glass panes can be inserted, with several vertical members between which cross members are affixed, whereby the vertical members have on an edge of an outer surface a corresponding channel for receiving a seal and adjacent to the channel a drainage channel for diverting liquids, whereby the cross member has on the side facing the outer surface of the vertical member a corresponding channel for receiving a seal and between the channels a retaining strip.

DE 34 19 538 A1 discloses a structure with vertical members and cross members for a facade or a roof with a metal framework, wherein glass panes can be inserted into the metal frames. The metal framework includes vertical members and transverse cross members which each have at their corresponding edges a channel for receiving a seal, so that a glass pane can be placed on a seal that extends peripherally around the edge of the glass pane. Cover profiles, which can be connected with screws to corresponding retaining channels disposed on the cross members and vertical members, are provided for securing the glass pane. Between the retaining channels and the channels for receiving the seals, there are provided drainage channels on both the cross members and the vertical members for diverting liquids that enter between the retaining channel and the glass pane of the cross member and/or vertical member. The cross member projects over the vertical member near the end faces of the channel that receives the seal and is therefore located somewhat higher than the vertical member. This difference in height is compensated towards the glass by glass support seals having different heights, i.e., the glass support seals for the cross members are not as high as the glass support seals for the vertical members. To implement this type of connection, the cross member profile has to be notched in the end region. Notching requires a more work, since the profiles cannot be simply sawn to their finished lengths. Handling the cross members for notching and the required fabrication techniques are complex in particular for long cross members. Moreover, the notching operation increases the tolerances since the cross member has to be sawn to size before being notched, so that the exact length of the cross member segment which contacts the vertical member requires greater tolerances due to the additional processing step.

It is therefore an object of the present invention to provide a structure with vertical members and cross members of the aforedescribed type, wherein the installation of the vertical members is simplified and the cross member has no longer be notched.

This object is solved with a structure with vertical members and cross members having the characterizing features of claim 1.

The overlapping construction is initially retained by installing on the end face of the cross member a connecting element which lengthens the channels and the retaining strip of the cross member and at least party covers the channel at the edge of the vertical member. The functionality of the channels and the retaining strip of the cross member is also preserved in the region of the vertical member near the edge. In particular, accumulating liquids can be diverted with the connecting element into the drainage channel of the vertical member. The cross member can be installed by simply sawing the cross member to the desired length. The cross member is subsequently installed between two vertical members, whereby the connecting element is affixed to the cross member either before or after installation. The cross member is hereby held between the vertical members with smaller tolerances, since the cross member is only sawn once and, unlike with conventional systems, the cross member need not be first cut to a suitable length and then notched. In addition, this simplifies the installation of the cross member, so that the additional costs of the connecting element do not have a negative impact.

According to an advantageous embodiment, the connecting element is affixed to the cross member. Those skilled in the art will appreciate that all conventional types of attachment methods, such as screw connections, adhesive joints, welding or other joining techniques are feasible. A mechanical attachment is preferred.

For installing the connecting element in a simple and fast manner, the element is preferably held on the cross member by way of a coupling element which is inserted into an undercut channel on the cross member and on the connecting element. The coupling element can be inserted into the channel on the cross member formfittingly and nonpositively, so that the coupling element is at least pre-attached. In particular, the coupling element can be easily held adjacent to the cross member profile, if the coupling element has at its end face a C-shaped section which encompasses the bottom of the connecting element, which also obviates the need for a tool for pre-installation. The leg of the C-shaped section, which is arranged at the bottom of the connecting element, is received in the drainage channel located at the edge of the vertical member, so that the C-shaped section does not impede contact between the connecting element and the vertical member.

Preferably, the cross member has a drainage channel on both sides of the retaining strip, with a corresponding coupling element inserted in each of the drainage channels. The coupling element can also be provided with channels for diverting liquids so as to preserve the functionality of the drainage channel.

According to another embodiment of the invention, ribs are formed on the connecting element which contact the cross member. Preferably, ribs which contact the channel walls and/or the retaining strip of the cross member are formed on the connecting element. In this way, the connecting element can be pre-attached to the cross member without requiring an additional component. The ribs can formfittingly contact the profile surface, so that the connecting element can only move in the axial direction of the cross member.

A particularly stable attachment of the connecting element with the ribs can be achieved by providing at least one recess on an end face of the cross member, through which a rib of the connecting element is inserted. In this way, a rib can engage below the channel bottom and/or the bottom of the retaining strip for supporting the connecting element over an area.

According to another embodiment of the invention, a cavity is formed below the connecting element, wherein a sealing compound can be introduced into the cavity for sealing a drainage channel that is formed on the cross member and the connecting element. Gaps can form when an additional component is employed near the transition between cross member and vertical member, which can lead to an accumulation of liquid. This can be prevented by sealing the gaps preferably with a sealing compound or an adhesive. The sealing compound is preferably introduced through an opening formed at the transition between cross member and connecting element.

To ensure a permanent mechanical attachment of the connecting element, the connecting element is preferably connected with the channel at the edge of the vertical member by a screw connection.

Figure 2:
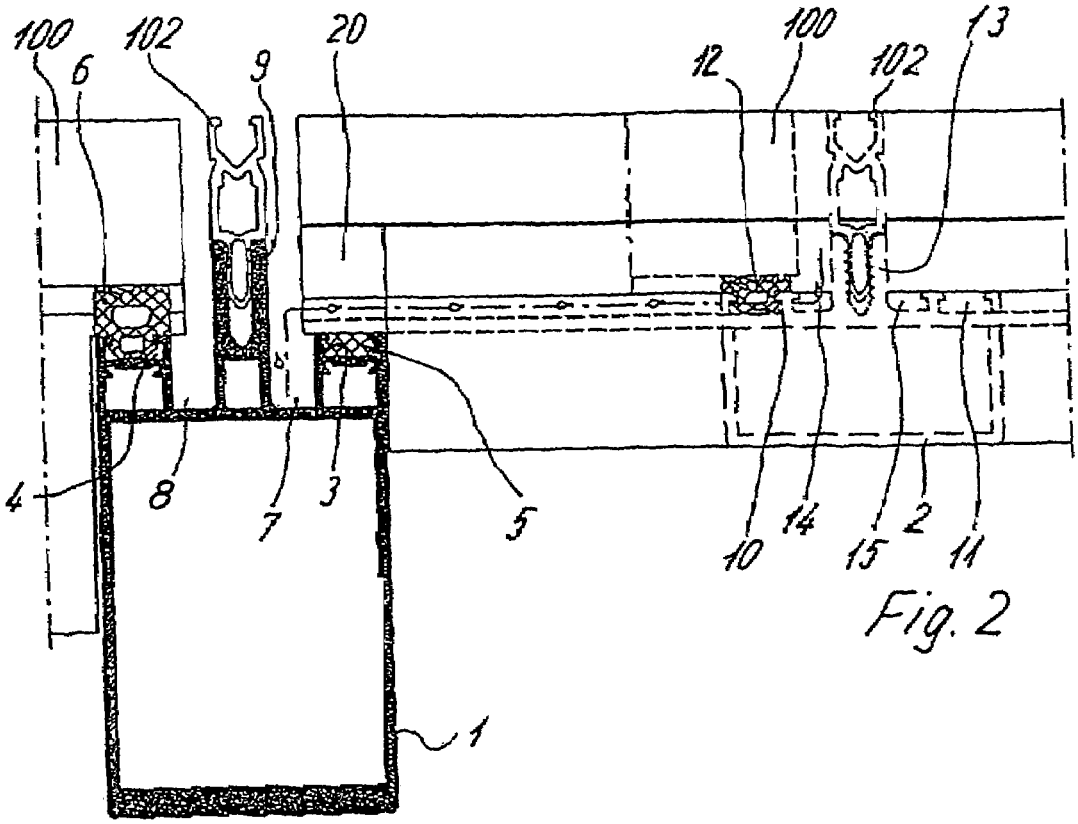
Figure 3:
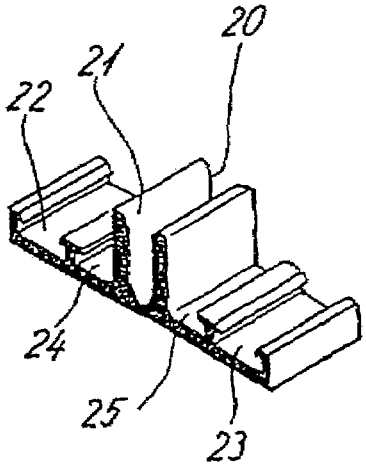
Figure 3:
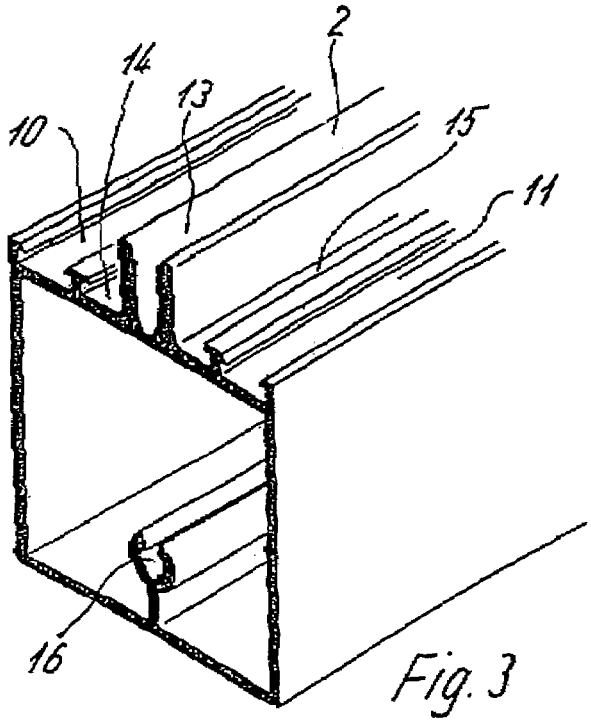
Figure 4:
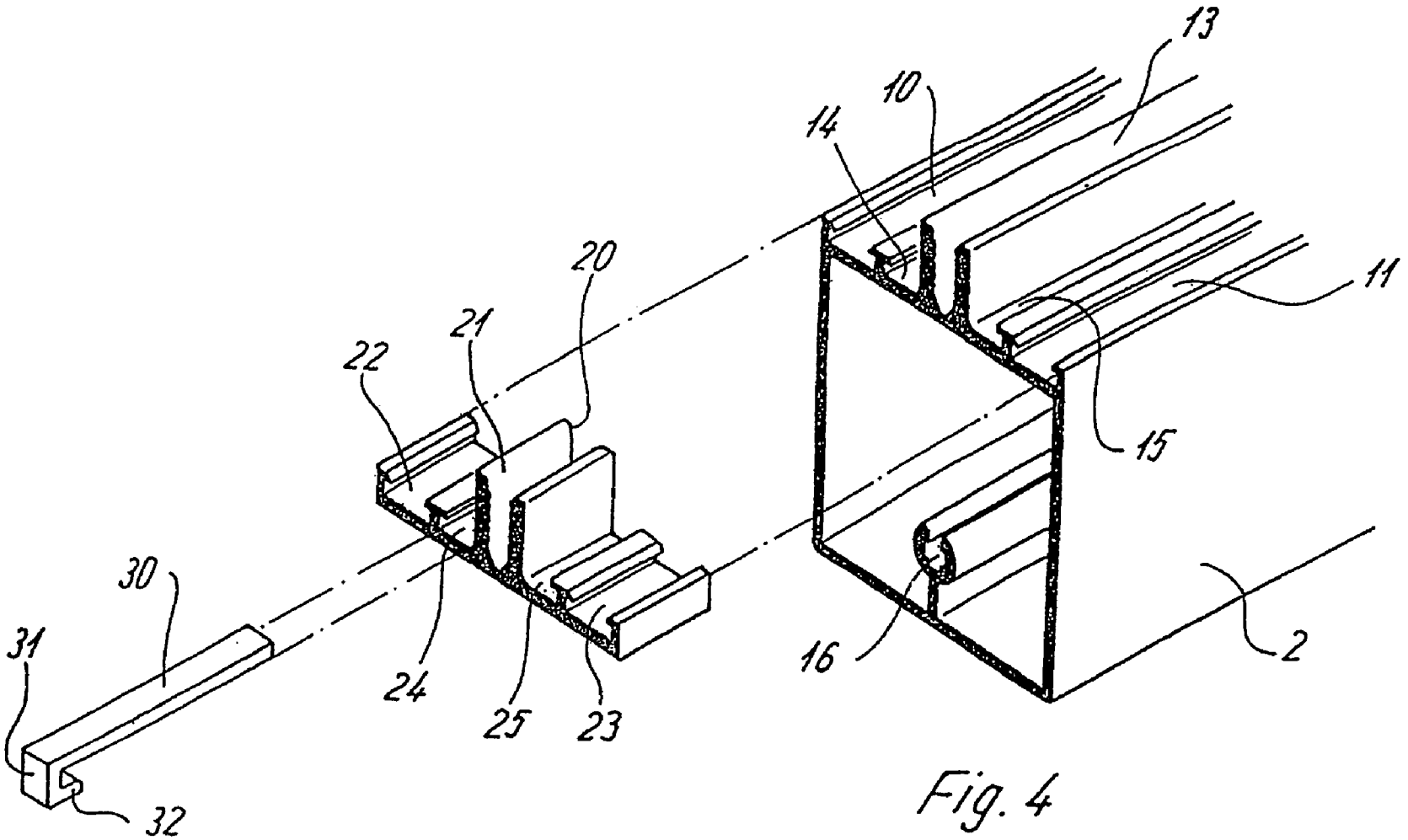
Figure 5:
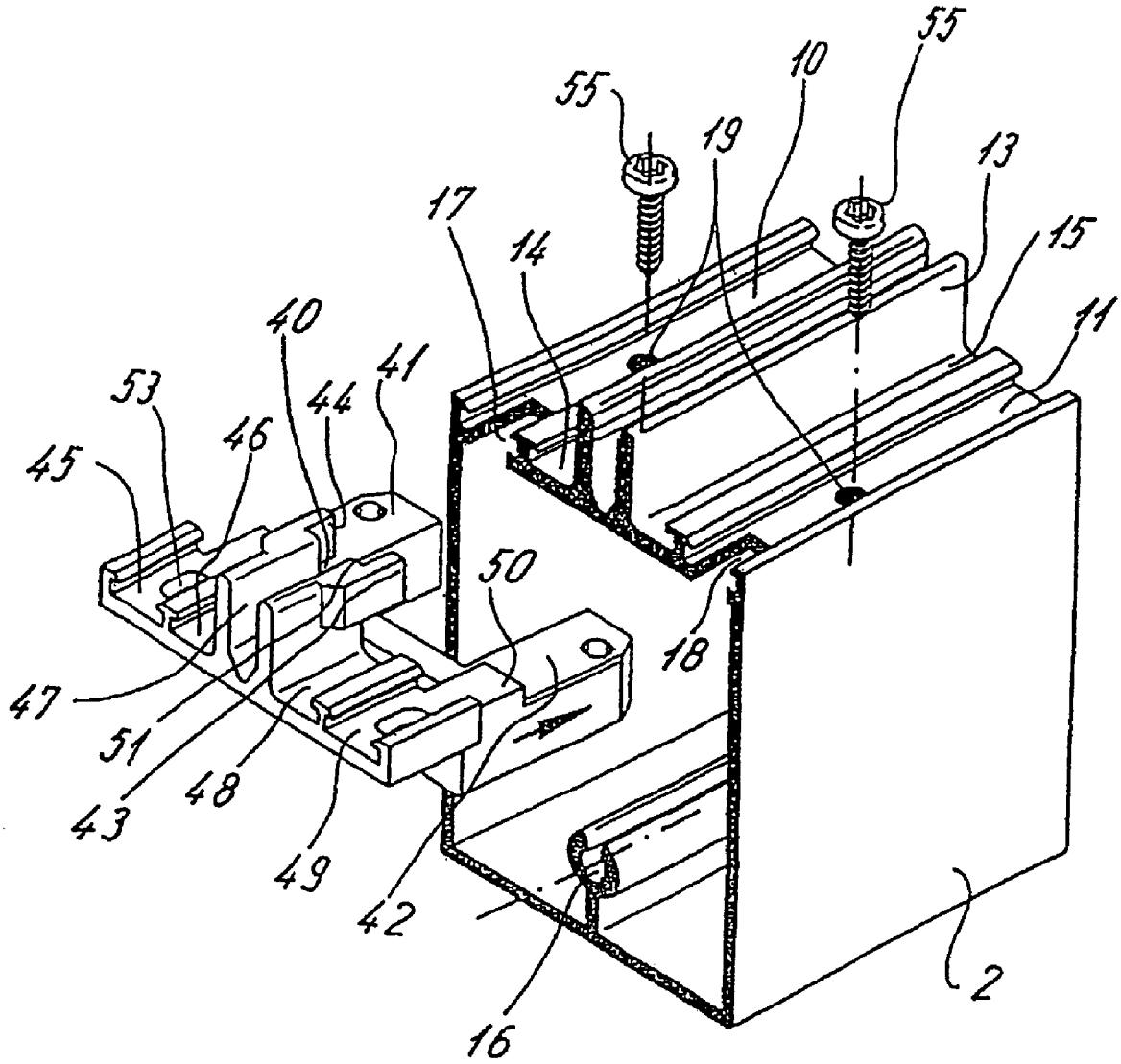
Figure 6:
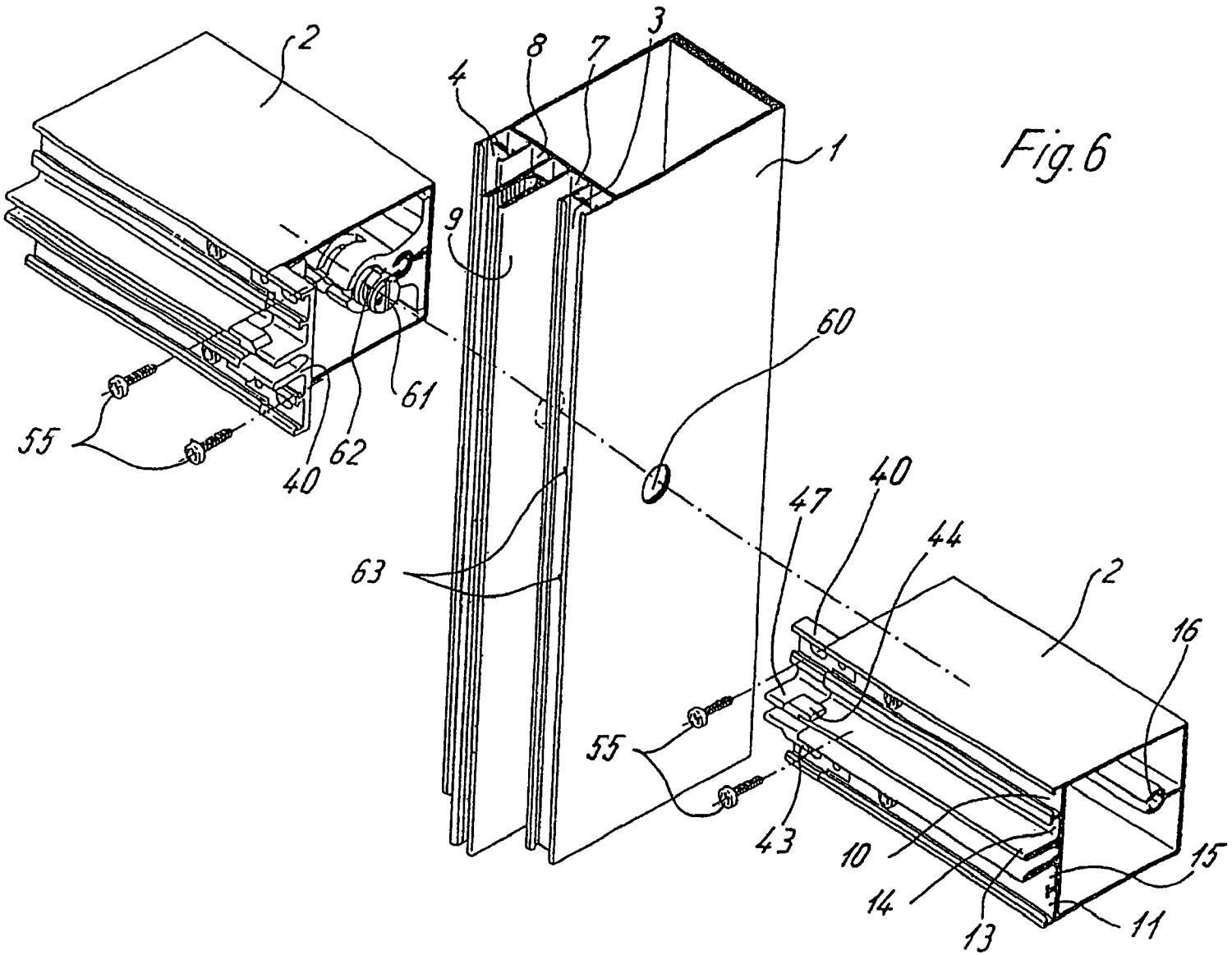
Figures 7A, 7B, 7C:
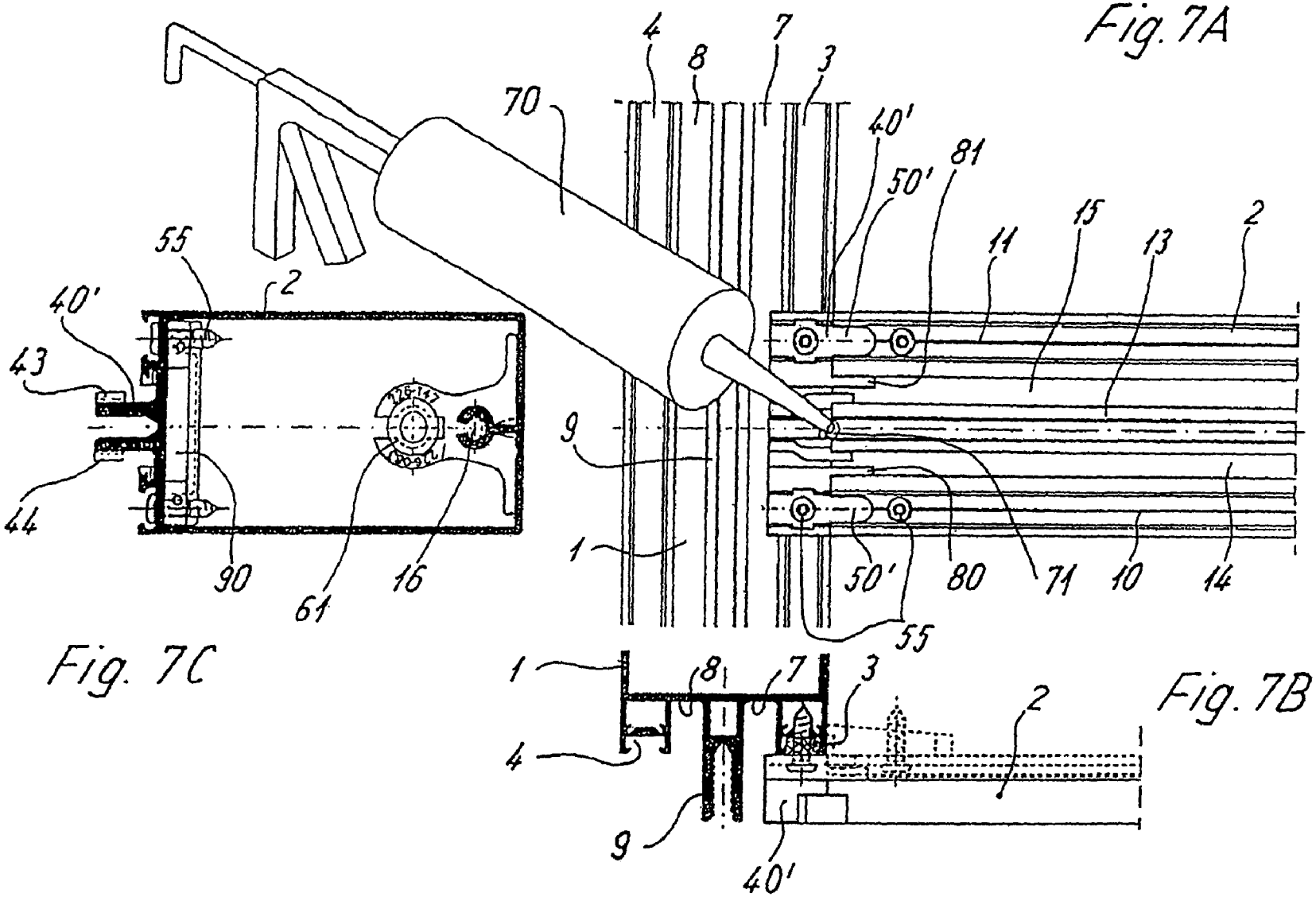

The invention will now be described with reference to three embodiments in conjunction with the appended drawings. It is shown in:

FIG. 1 a perspective view of a first embodiment of a structure with vertical members and cross members according to the invention;

FIG. 2 a schematic cross-sectional view of the structure with vertical members and cross members of FIG. 1;

FIG. 3 a perspective view of the cross member and the connecting element of the structure with vertical members and cross members of FIG. 1;

FIG. 4 a perspective view of the cross member and the connecting element according to FIG. 3 with a coupling element;

FIG. 5 a perspective view of a cross member with a connecting element according to a second embodiment of the present invention;

FIG. 6 a perspective view of the structure with vertical members and cross members according to the second embodiment;

FIG. 7A a side view of the structure with vertical members and cross members according to a third embodiment;

FIG. 7B a partial cross-sectional top view of the structure with vertical members and cross members according to FIG. 7A; and FIG. 7C a front view of the cross member of the structure with vertical members and cross members according to FIG. 7A.

As shown in FIGS. 1 and 2, the structure with vertical members and cross members includes a vertical member 1, with a cross member 2 connected to the vertical member 1 at a right angle. Alternatively, the cross member 2 could be connected to the vertical member 1 at a right angle. The vertical member 1 has channels 3 and 4 disposed along the edges and adapted to receive a glass support seal. A drainage channel 7 that can divert liquids downwardly is provided adjacent to the channel. The opposite side also includes a drainage channel 8. A retaining strip 9, in which an installation element 102 can be inserted, is located in the center of the vertical member 1. As seen in FIG. 2, glass panes 100 can be inserted into the areas formed by the vertical members 1 and the cross members 2, with the glass panes 100 being placed on top of the glass support seals 5, 6 and 12. The glass panes 100 are secured to the installation element 102 and thereby also to the vertical members 1 and the cross member 2 by way of cover strips (not shown).

FIG. 2 shows schematically several droplets which represents moisture entering between the glass pane 100 and the drainage channel 14 of the cross member 2. The moisture is diverted via the drainage channels 14 and 15 on the cross member 2 to the drainage channel 7 of the vertical member 1 and discharged from the structure consisting of vertical members and cross members. The glass panes 100 are not contacted, since these are disposed on top of the glass support seals 5 and 12, whereby the difference in height towards the glass is compensated by glass support seals 5 and 12 having different heights.

A retaining strip 13 is provided on the cross member 2, with drainage channels 14 and 15 encompassing the retaining strip 13 on both sides.

As seen in particular in FIG. 3, the overlapping region adjacent to the channel 3 of the vertical member 1 is formed by a connecting element 20 which is formed separate of the cross member 2 and is affixed to the cross member 2. The connecting element 20 includes retaining channels 22 and 23, each channel for a corresponding glass support seal, which are aligned with the retaining channels 10 and 11 of the cross member 2. The profile of the connecting element 20 matches the profile of the outer surface of the cross member 2. Also provided on the cross member 2 is a fastening strip 16 for securely fastening the cross member 2 to the vertical member 1.

According to a first embodiment of the invention, the connecting element 20 is secured to the cross member 2 with a coupling element 30 (FIG. 4). The coupling element 30 includes at its end face a C-shaped section 31, wherein the lower leg 32 engages below the bottom of the connecting element 20. The coupling element 30 is preferably formfittingly and nonpositively inserted in the drainage channel 24 and/or 25 in the connecting element 20 and the cross member 2, wherein the nonpositive engagement can be reinforced by providing projections or teeth on the coupling element 30. The projections and/or teeth dig into the profile and the drainage channels 24 and 25, respectively. The coupling element 30 can also be affixed with a screw connection. One or several coupling elements 30 can be used. The attachment position can be varied; for example, the coupling element 30 can also be arranged in the channels 22 and 23 as well as on or in the retaining strip 20.

FIG. 5 shows a second embodiment, wherein holding means are integrally formed on one connecting element 40. The connecting element 40 includes on each of its edges a corresponding retaining channel 45 and 49 and in the center an attachment strip 47. A drainage channel 46 is arranged between the attachment strip 47 and the channel 45, and a corresponding drainage channel 48 is arranged on the opposite side. The profile of the connecting element 40 again corresponds to the profile of the cross member 2, wherein the channels 45, 46, 48 and 49 are aligned with the corresponding channels 11, 14, 15, 11 of the cross member 2.

Several rib-shaped sections, which contact the profile of the cross member 2 at various points, are provided for pre-attaching the attachment element 40. Legs 44 and 43 are formed on the attachment strip 47 which laterally grip around the two walls of the attachment strip 13. A limit stop is formed on the leg 43, with a corresponding limit stop being provided on the leg 44, so that the legs 43 and 44 formfittingly contact the end face of the attachment strip 13 and thereby fix the position of the connecting element 40 in the lateral direction.

Recesses 17 and 18, into which a section of the connecting element 40 can be inserted, are provided on the end faces of the cross member 2 in the region of the channels 10 and 11. Bottom sections 41 and 42 are provided on the connecting element 40, which partially engage below the channels 10 and 11. Openings are formed in the bottom ribs 41 and 42, so that the connecting element 40 can be secured on the cross member 2 with screws 55, wherein the screws 55 extends through openings 19 in the channels 10 and 11. A stop 15 is formed on the bottom rib 42 which formfittingly engages with the recess 18 of the channel 11. The section which is guided through the recesses 17 and 18 operates as a coupling bridge for making contact with the hollow profile of the cross member 2 with the bottom ribs 42 and 41. Several of these coupling bridges can be provided. The connecting element 40 can also be attached to the cross member 3 by using other attachment methods.

Slots 56 are provided in the connecting element 40 for securing the connecting element 40 to the vertical member 1 by a screw connection.

FIG. 6 shows a cross member 2 with a connecting element 40 in a structure with vertical members and cross members. The connecting element 40 is affixed to the side of the cross member 2 with the legs 43 and 44, wherein the connecting element 40 is permanently attached with screws 55, which are screwed into the cross member 2 and the connecting element 40. To support large forces, a movable pin 61, which is inserted into an opening 60 on the vertical member 1, is attached to the attachment strip 16. A groove 62 which has approximately the same thickness as a wall of the vertical member 1 is provided on the pin 61 so that the cross member 2 can be interlocked with the vertical member 1. The connecting element 40 is in addition secured to the vertical member 1 with screws 55, whereby the screws 55 extend through the slots 53 and the openings 63 within the groove 3 of the vertical member 1.

FIGS. 7A, 7B and 7C depict a third embodiment of the invention which is slightly different from the second embodiment. However, identical elements have identical reference numerals.

The connecting element 40' includes sections 50' which engage with corresponding recesses in the channels 10 and 11 of the cross member 2, wherein the end faces of the sections 50' are rounded. In addition, additional ribs 80 and 81 are formed on the connecting element 40' which engage with the drainage channels 14 and 15 of the cross member 2. All other features of the connecting element 40' are identical to those of the connecting element 40. The height of the connecting element 40' is fixed by the bottom ribs 41 and 42 as well as the ribs 80 and 81. The lateral position is fixed by the legs which encompass the attachment strip 13. Screws 55 are also inserted into the connecting element 40' to provide a mechanical connection. In addition, screws 55 are screwed into the groove 3 of the vertical member 1.

As seen in particular from FIG. 7C, a cavity 90 is located below the drainage channels 14 and 15 of the cross member 2 adjacent to the connecting element 40'. The cavity 90 is surrounded on three sides by the connecting element 40', with the vertical member 1 contacting the open side. A sealing compound can be filled into the cavity 90 for sealing the transition region between the cross member 2 and the vertical member 1, in particular also in the region of the drainage channels 14 and 15. For this purpose, a handheld device 70 is provided which contains the sealing compound. This handheld device 70 can be used to fill the sealing compound into the cavity 90 through an opening 71 formed between the connecting element 40' and the cross member 2. In this way, the connecting region between the connecting element 40' and the cross member 2 can be reliably sealed. The cavity 90 can also be filled with an adhesive, so that an adhesive connection with the cross member 2 can be established by using a suitably designed connecting element 40'.

The invention claimed is:

1. Structure with vertical members and cross members, comprising:

a plurality of vertical members, each vertical member having two vertical channels disposed along outer surfaces of the vertical member, said vertical channels adapted to receive a seal, and a drainage channel disposed between the vertical channels;

a cross member having flat end faces extending over the entire cross-sectional area of the cross member, the cross member being affixed between the vertical members with the flat end faces facing the outer surfaces of corresponding vertical members, said cross member including cross channels disposed along marginal edges and terminating at the outer surface of the vertical members, said cross channels adapted to receive a seal, and a retaining strip positioned between the cross channels and terminating at the outer surface of the vertical members, said vertical members and cross members defining frame areas adapted for insertion of glass panes;

a connecting element formed separately from and connected flush to a corresponding one of the flat end faces of the cross member, said connecting element having a contour substantially matching a contour of the cross member and lengthening the cross channels and the retaining strip of the cross member so as to cover the vertical channels disposed along the outer surfaces of the vertical member and to be open to the drainage channel to allow liquids to drain from the cross member into the drainage channel in the vertical members.

2. The structure of claim 1, wherein the connecting element is affixed to the cross member.

3. The structure of claim 1, and further comprising a coupling element inserted into an undercut channel disposed on the cross member and on the connecting element and securing the connecting element to the cross member.

4. The structure of claim 3, wherein the coupling element is formfittingly and nonpositively inserted into the undercut channel disposed on the cross member.

5. The structure of claim 3, wherein the coupling element has an end face in form of a C-shaped section which encloses a bottom section of the connecting element.

6. The structure of claim 5, wherein a leg of the C-shaped section is received in the drainage channel of the vertical member.

7. The structure of claim 1, wherein the cross member comprises drainage channels disposed on both sides of the retaining strip, and coupling elements inserted in the drainage channels in one-to-one correspondence.

8. The structure of claim 1, wherein the connecting element includes projections that contact the cross member.

9. The structure of claim 1, wherein the connecting element includes projections which contact channel walls or the retaining strip of the cross member.

10. The structure of claim 1, wherein the connecting element includes at least one projection which engages behind an outer surface of the cross member.

11. The structure of claim 1, wherein the end face of the cross member has at least one recess, with a projection formed on the connecting element and extending through the at least one recess.

12. The structure of claim 1, wherein a cavity is formed below the connecting element, said cavity adapted to receive a sealing compound for sealing a drainage channel that is formed on the cross member and the connecting element.

13. The structure of claim 1, wherein the connecting element is secured to the vertical channels by a screw connection.

14. The structure of claim 1, wherein the connecting element comprises cross channels disposed along marginal edges of the connecting element and a retaining strip positioned between the cross channels of the connecting element, said connecting element terminated at end faces, wherein in an installed position of the connecting element on the cross member, one of the end faces of the connecting element abuts a corresponding one of the end faces of the cross member, and the cross channels and the retaining strip of the connecting element are aligned with the cross channels and the retaining strip of the cross member.

15. The structure of claim 1, for use in a facade.

16. The structure of claim 1, for use in a roof window.

* * * * *